US007434888B2

(12) United States Patent
Lin

(10) Patent No.: US 7,434,888 B2
(45) Date of Patent: Oct. 14, 2008

(54) CHAIR HAVING ADJUSTABLE WEIGHT PROPORTION ACCEPTING ELEMENTS

(76) Inventor: Peter Lin, No. 16, Lane 207, Tsu Tzu Rd., Nan Tou City, Nan Tou Hsien (TW)

( * ) Notice: Subject to any disclaimer, the term of this patent is extended or adjusted under 35 U.S.C. 154(b) by 0 days.

(21) Appl. No.: 11/564,386

(22) Filed: Nov. 29, 2006

(65) Prior Publication Data

US 2008/0122285 A1 May 29, 2008

(51) Int. Cl.
*A47C 7/14* (2006.01)

(52) U.S. Cl. ..... 297/452.56; 297/452.13; 297/452.63; 297/452.64

(58) Field of Classification Search ..... 297/452.13, 297/452.56, 452.63, 452.64
See application file for complete search history.

(56) References Cited

U.S. PATENT DOCUMENTS

| | | | | |
|---|---|---|---|---|
| 430,703 | A * | 6/1890 | Spahn et al. | 297/452.13 X |
| 1,273,521 | A * | 7/1918 | Morris | 297/452.13 X |
| 3,107,944 | A * | 10/1963 | Baermann | 297/452.56 |
| 3,120,407 | A * | 2/1964 | Propst | 297/452.13 X |
| 3,224,017 | A * | 12/1965 | Zerbee | 297/452.64 |
| 4,318,556 | A * | 3/1982 | Rowland | 297/452.64 X |
| 5,405,179 | A * | 4/1995 | Jih | 297/452.63 X |
| 6,059,368 | A * | 5/2000 | Stumpf et al. | 297/452.64 X |
| 6,082,824 | A * | 7/2000 | Chow | 297/452.56 |
| 6,264,279 | B1 * | 7/2001 | Chow | 297/452.56 |
| 6,588,842 | B2 * | 7/2003 | Stumpf et al. | 297/452.64 X |
| 6,755,477 | B2 * | 6/2004 | Chow | 297/452.56 |
| 6,786,544 | B1 * | 9/2004 | Muraishi | 297/452.56 X |
| 6,957,861 | B1 * | 10/2005 | Chou et al. | 297/452.64 X |
| 6,983,997 | B2 * | 1/2006 | Wilkerson et al. | 297/452.56 |
| 7,066,550 | B1 * | 6/2006 | Su | 297/452.56 X |
| 7,237,847 | B2 * | 7/2007 | Hancock et al. | 297/452.56 |
| 7,267,408 | B2 * | 9/2007 | Xiang | 297/452.64 X |
| 7,270,378 | B2 * | 9/2007 | Wilkerson et al. | 297/452.56 |
| 2002/0060493 | A1 * | 5/2002 | Nishino et al. | 297/452.56 |
| 2007/0102987 | A1 * | 5/2007 | Chen | 297/452.56 |

OTHER PUBLICATIONS

Taiwanese Patent No. M288142, Mar. 1, 2006, 6 pages.

* cited by examiner

*Primary Examiner*—Rodney B. White
(74) *Attorney, Agent, or Firm*—Alan Kamrath; Kamrath & Associates PA

(57) ABSTRACT

A seat includes a tray, a net mounted on the tray and a supporting device provided between the tray and the net. Thus, when a user sits on the seat, the net takes a proportion of the user's weight while the supporting device takes another proportion of the user's weight.

18 Claims, 7 Drawing Sheets

CHAIR HAVING ADJUSTABLE WEIGHT PROPORTION ACCEPTING ELEMENTS

BACKGROUND OF INVENTION

1. Field of Invention

The present invention relates to a chair and, more particularly, to a seat for use in a chair.

2. Related Prior Art

According to Taiwanese Patent M288142, a chair 1 includes a plurality of legs 2, a post mounted on the legs 2, a seat 3 mounted on the post and a backrest mounted on the seat 3. The seat includes a plate 31 mounted on the post and a net 32 mounted on the plate 31. The plate 31 is rigid for supporting the net 32. The net 32 is elastic for flexibly supporting a user's hips. A space 33 is defined between the net 32 and the plate 31. Air is allowed to travel into and from the space 33. Thus, heat does not accumulate below the user's hips. However, due to fatigue after some time of use, the net 32 inevitably loses the elasticity and the ability to support the user's hips and keep the space 33.

The present invention is therefore intended to obviate or at least alleviate the problems encountered in the prior art.

SUMMARY OF INVENTION

According to the present invention, a seat includes a tray, a net mounted on the tray and a supporting device provided between the tray and the net. Thus, when a user sits on the seat, the net takes a proportion of the user's weight while the supporting device takes another proportion of the user's weight.

The primary advantage of the seat according to the present invention is that the net lasts long, since it takes only proportion of the user's weight while the supporting device takes another proportion of the user's weight.

Other advantages and features of the present invention will become apparent from the following description referring to the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
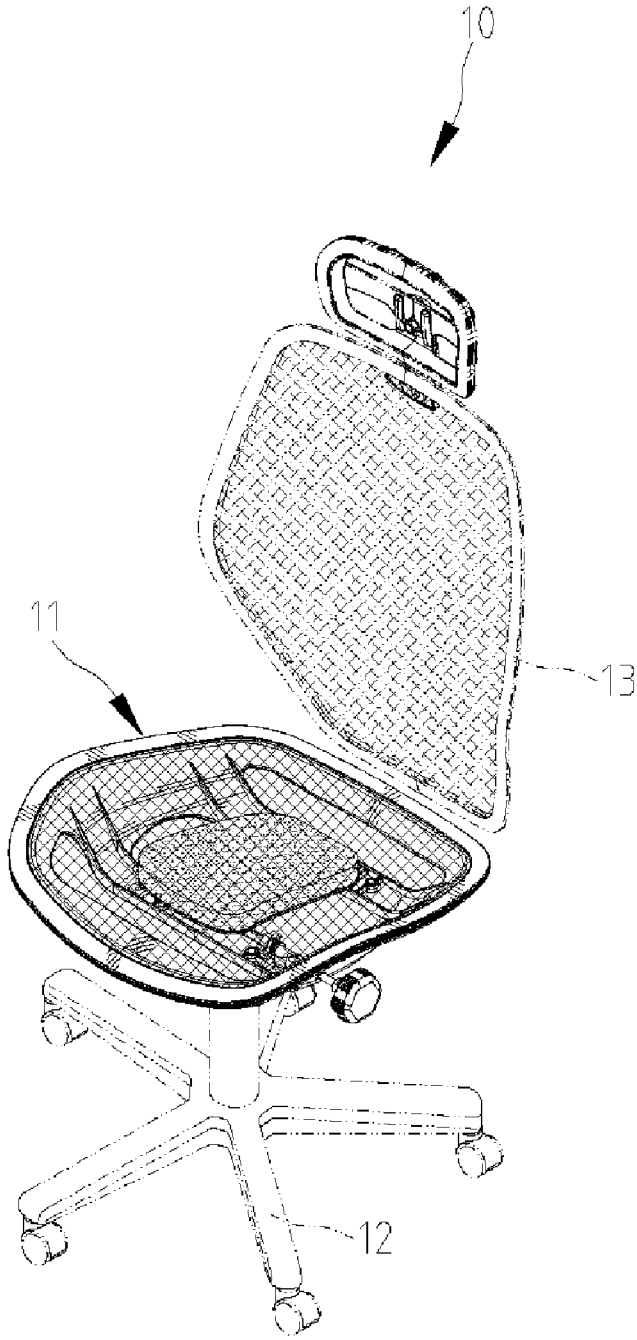
FIG. 1 is a perspective view of a seat for use in a chair according to the preferred embodiment of the present invention.

Referring to FIG. 1, a chair 10 includes a seat 11 according to the preferred embodiment of the present invention. The chair 10 includes a plurality of legs 12, a post for connecting the legs 12 to the seat 11 and a backrest 13 connected to the seat 11.

Figure 2:
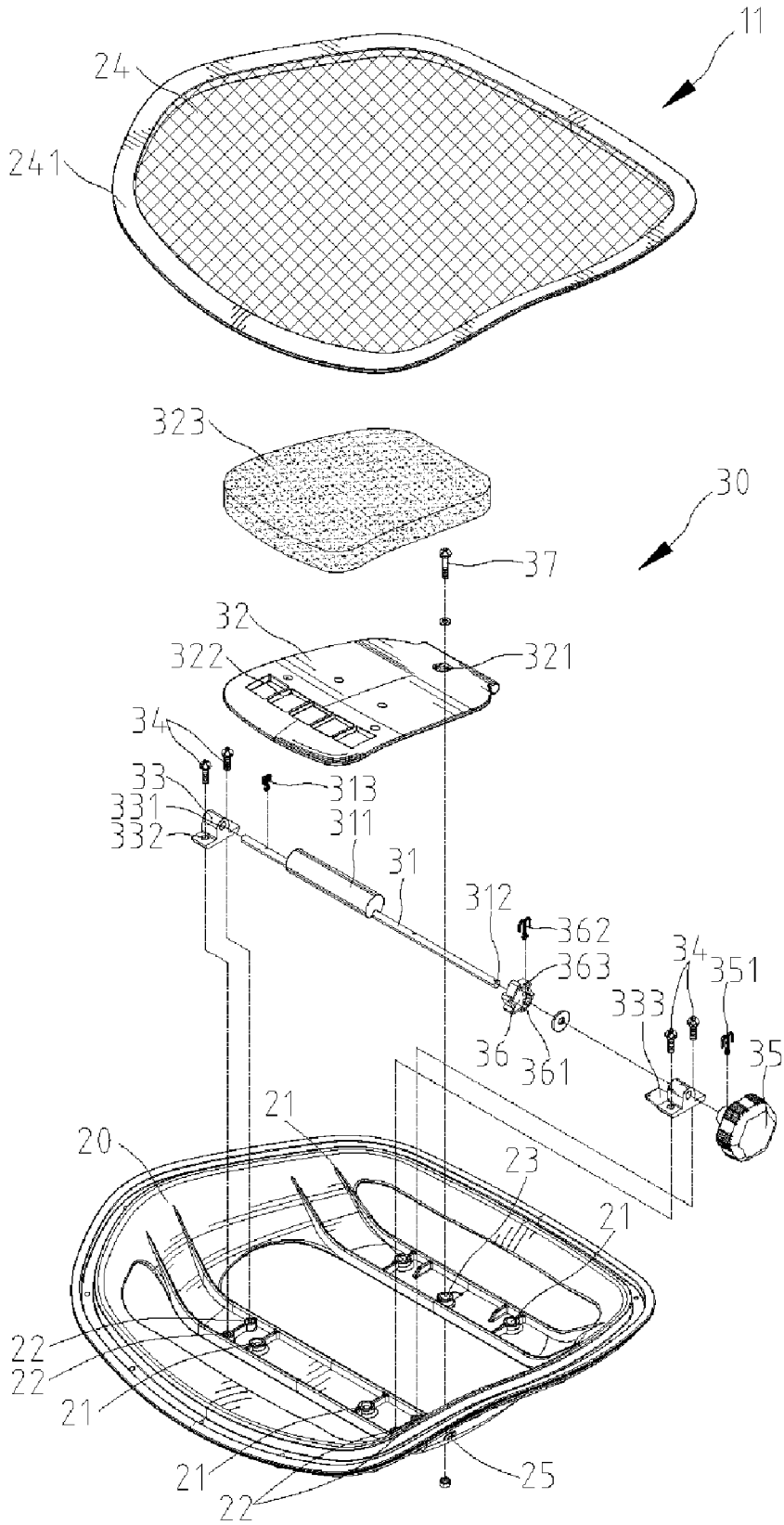
FIG. 2 is an exploded view of the seat shown in FIG. 1.

Referring to FIG. 2, the seat 11 includes a tray 20 connected to the post, a net 24 mounted on the tray 20 and a supporting device 30 disposed between the net 24 and the tray 20.

The tray 20 defines a plurality of screw holes 21, a plurality of screw holes 22 near a front edge, a screw hole 23 near a rear edge and an aperture 25 near a lateral edge.

A plurality of threaded bolts (not shown) can be driven into the screws holes 21 through a plurality of apertures defined in a platform (not shown) mounted on the post. Thus, the tray 20 is connected to the post through the platform.

The net 24 is located within and connected to a frame 241. Thus, the net 24 is supported by the frame 241. The frame 241 is connected to the tray 20. Thus, the net 24 is connected to tray 20. The net 24 may be replaced with a web or a sheet.

The supporting device 30 includes a first bearing 33, a second bearing 33, an adjusting element 31, a knob 35, a positioning element 36 and a plate 32. Each of the bearings 33 defines a tunnel 331 and two apertures 332. The second bearing 33 is formed with a tab 333.

A plurality of threaded bolts 34 is driven into the screw holes 22 through the apertures 332. Thus, the bearings 33 are connected to the tray 20.

The adjusting element 31 includes a cam 311 formed on an axle 312 so that the axle 312 includes a first portion on a side of the cam 311 and a second portion on an opposite of the cam 311. The first portion of the axle 312 is mounted on the first bearing 33. The second portion of the axle 312 is mounted on the second bearing 33. A pin 313 is driven into the first portion of the axle 312 for precisely locating the cam 311 beneath the plate 32. The second portion of the axle 312 is inserted through the aperture 25.

A pin 351 is driven into the second portion of the axle 312 through a portion of the knob 35. Thus, the adjusting element 31 is connected to the knob 35, and the adjusting element 31 can be driven by the knob 35.

The positioning element 36 includes a hub 361 and a plurality of spokes 363 extended from the hub 361. Each of the spokes 363 is biased from a radius of the hub 361.

The hub 361 is disposed on the second portion of the axle 312. Two selective adjacent ones of the spokes 363 are engaged with the tab 333. A pin 362 is driven into the second portion of the axle 312 through the hub 361. Thus, the axle 312 is connected to the positioning element 36.

The plate 32 includes an aperture 321 therein near a rear edge and a plurality of ribs 322 on the bottom near a front edge.

A threaded bolt 37 is driven into the screw hole 23 through the aperture 321. Thus, the tray 20 is connected to the plate 32. The ribs 322 are in contact with the cam 311.

A pad 323 is made of soft material and disposed on the top of the plate 32.

Figure 3:
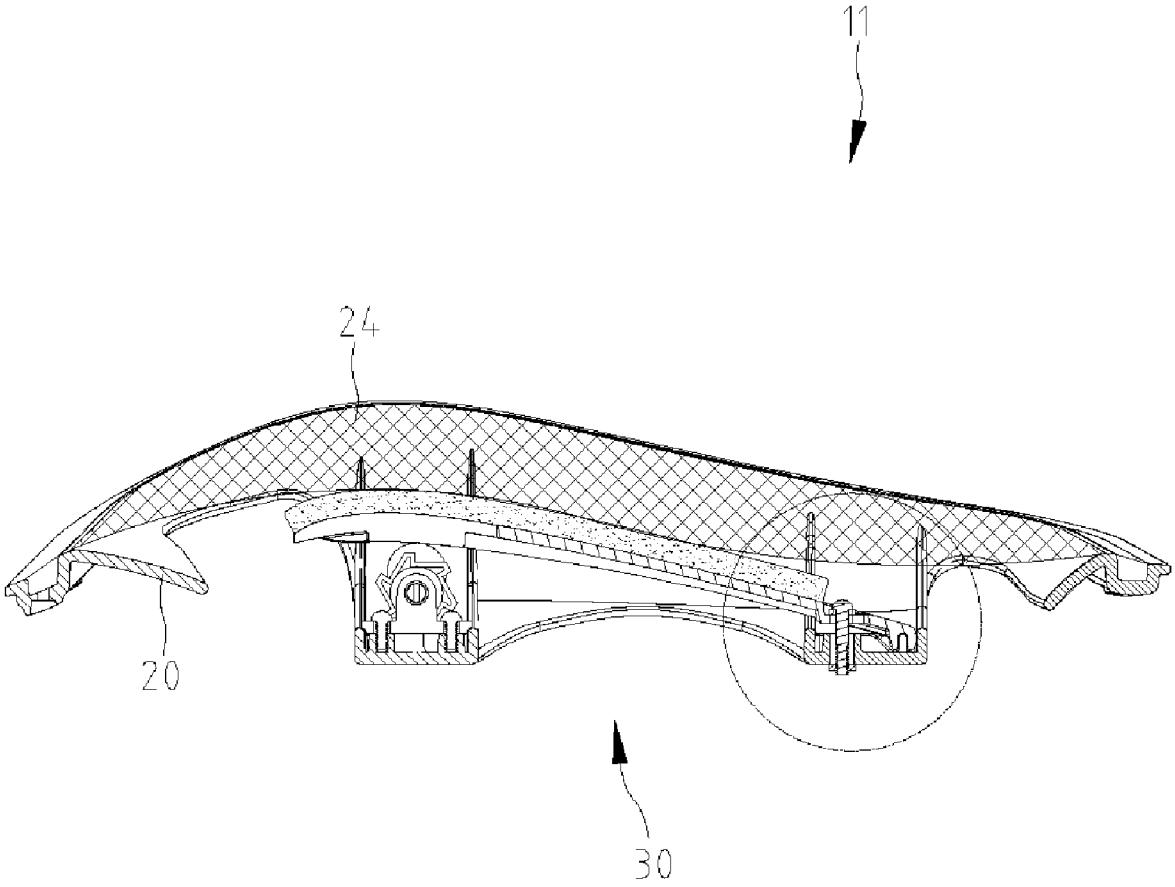
FIG. 3 is a cross-sectional view of the seat shown in FIG. 1.
Figure 4:
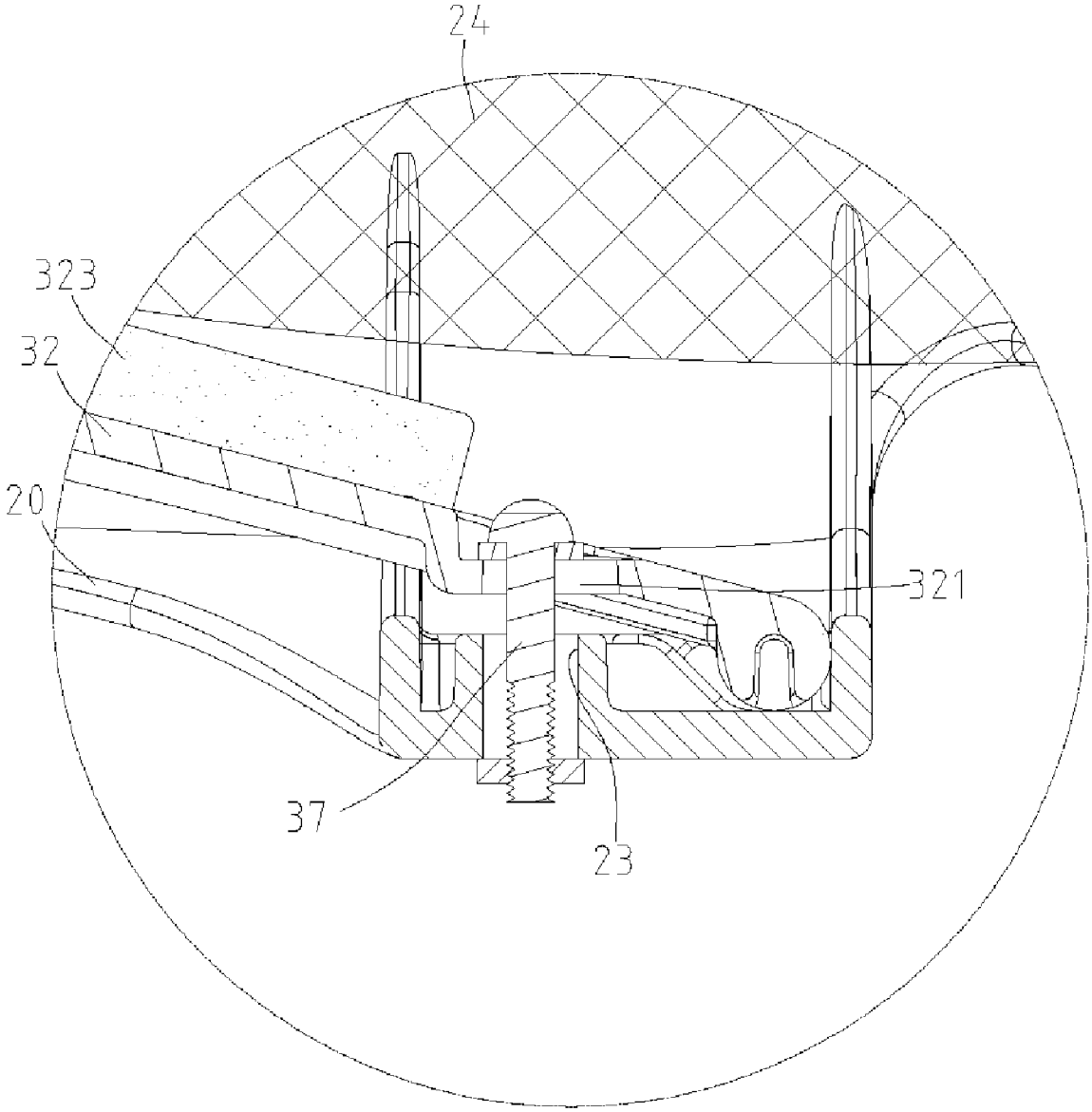
FIG. 4 is an enlarged partial view of the seat shown in FIG. 3.
Figure 5:
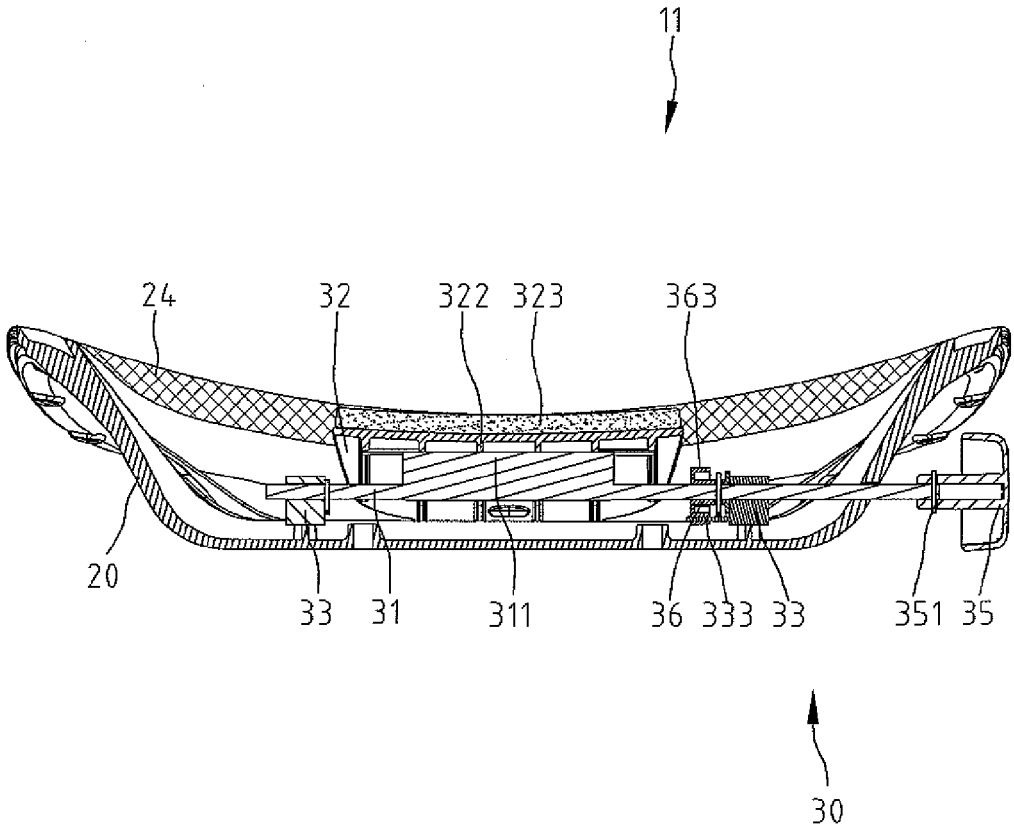
FIG. 5 is another cross-sectional view of the seat shown in FIG. 1.

Referring to FIGS. 3 through 5, the pad 323 and the plate 32 are in an upper position. The pad 323 is in contact with the net 24. When a user sits on the seat 11, the pad 323 and the plate 32 will take a largest proportion of the user's weight while the net 24 will take a smallest proportion of the user's weight.

Figure 6:
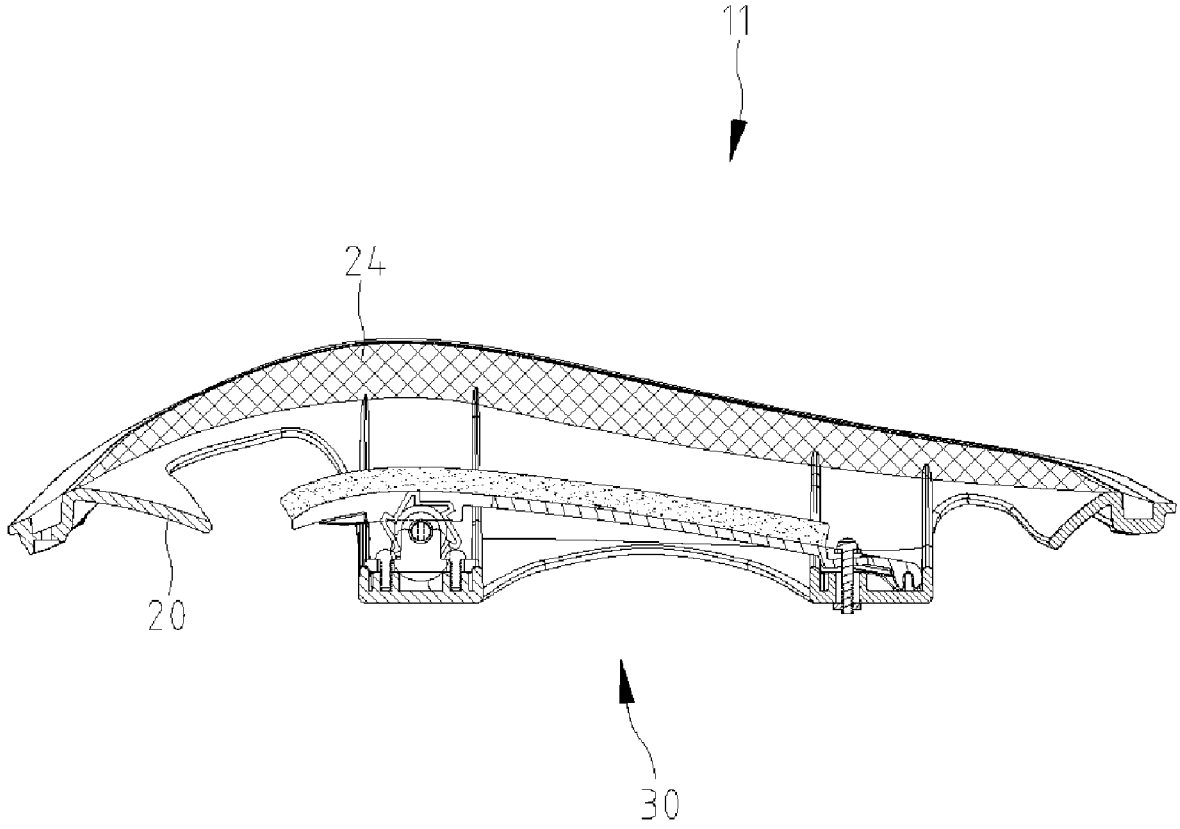
FIG. 6 is a cross-sectional view of the seat in another position than shown in FIG. 4.
Figure 7:
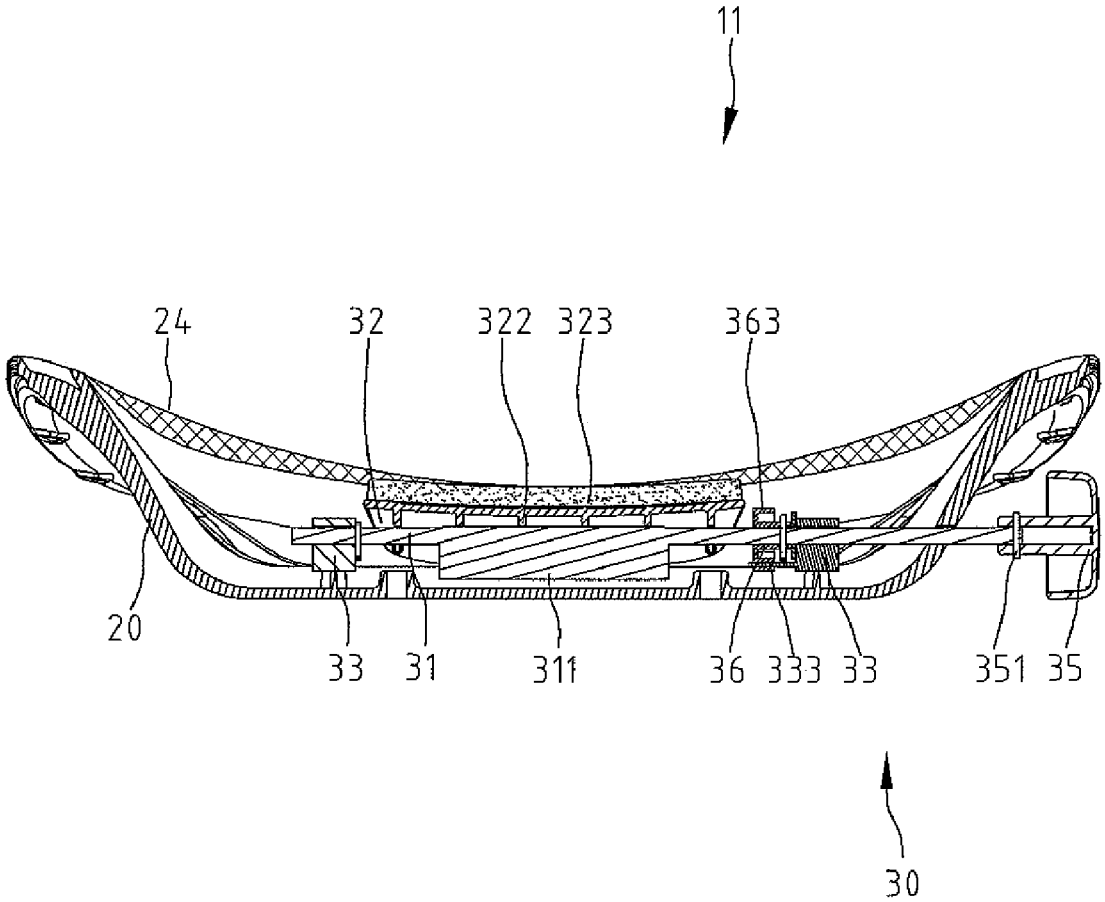
FIG. 7 is another cross-sectional view of the seat shown in FIG. 6.

Referring to FIGS. 6 and 7, the pad 323 and the plate 32 are in a lower position. The pad 323 is away from the net 24. When the user sits on the seat 11, the pad 323 and the plate 32 will take a smallest proportion of the user's weight while the net 24 will take a largest proportion of the user's weight.

The pad 323 and the plate 32 can be moved between the upper and lower positions by turning the knob 35. The pad 323 and the plate 32 can be retained in a desired position by the engagement of the spokes 363 with the tab 333.

The seat according to the present invention exhibits several advantages. Firstly, the net lasts long, since it takes only proportion of the user's weight while the supporting device takes another proportion of the user's weight.

Secondly, it enables the user to choose how he or she should be supported. Wishing to have a hard feel, the user disposes the pad and the plate in the upper position. Wishing to have a soft feel, the user disposes the pad and the plate in the lower position.

Thirdly, the pad and the plate can be retained in a desired one of several positions.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A seat comprising a tray; a plate mounted to the tray; and a net mounted on the tray, with the plate provided between the tray and the net with the net being deflectable towards the plate, wherein when a user sits on the seat, the net takes a proportion of the user's weight while the plate takes another proportion of the user's weight; and an adjusting element retaining the plate at one of various positions spaced from the tray to vary the proportion of the user's weight taken by the net, and wherein the tray is bowl shaped and includes a rim and an interior, with the net including a periphery connected to the rim of the tray, with the net extending over the interior of the tray, with the plate located within the interior of the tray.

2. The seat according to claim 1 wherein the adjusting element comprises a threaded bolt and the plate defines an aperture, and the tray defines a screw hole for receiving the threaded bolt inserted through the aperture of the plate, with rotation of the screw spacing the tray at the one of the various positions.

3. The seat according to claim 2 wherein the plate has a portion connected to the tray and another portion for contact with the net when the user sits on the seat.

4. The seat according to claim 2 wherein the adjusting element comprises a threaded bolt, and the plate defines an aperture, and the tray defines a screw hole for receiving the threaded bolt inserted through the aperture of the plate, with rotation of the screw spacing the tray at the one of the various positions.

5. The seat according to claim 4 further comprising a pad mounted on the plate and intermediate the plate and the net for contact with the net when the user sits on the seat.

6. The seat according to claim 2 further comprising a pad mounted on the plate and intermediate the plate and the net for contact with the net when the user sits on the seat.

7. The seat according to claim 1 comprising a frame for supporting the net.

8. The seat according to claim 1 further comprising a pad mounted on the plate and intermediate the plate and the net for contact with the net when the user sits on the seat.

9. A seat comprising a tray, a net mounted on the tray and a supporting device provided between the tray and the net so that when a user sits on the seat, the net takes a proportion of the user's weight while the supporting device takes another proportion of the user's weight, wherein the supporting device comprises a plate with a portion connected to the tray and another portion for contact with the net when the user sits on the seat, wherein the supporting device comprises an adjusting element for adjusting the height of the plate on the tray, wherein the adjusting element comprises an axle rotationally mounted on the tray and a cam formed on the axle and located beneath the plate.

10. The seat according to claim 9 wherein the supporting device comprises two bearings for supporting the axle.

11. The seat according to claim 10 wherein each of the bearings defines a tunnel for receiving a portion of the axle.

12. The seat according to claim 10 wherein the supporting device comprises a plurality of threaded bolts, and each of the bearings defines a plurality of apertures, and the tray defines a plurality of screw holes for receiving the threaded bolts inserted through the apertures of the bearings.

13. The seat according to claim 9 wherein the tray defines an aperture, and the axle comprises a portion inserted through the aperture of the tray, and the supporting device comprises a knob connected to the portion of the axle.

14. The seat according to claim 13 wherein the supporting device comprises a pin driven into the axle through the knob.

15. The seat according to claim 9 wherein the supporting device comprises a positioning element connected to the axle for retaining the adjusting element in a desired one of several positions.

16. The seat according to claim 15 wherein the supporting device comprises a tab connected to the tray, and the positioning element comprises a hub mounted on the axle and a plurality of spokes extended from the hub and engaged with the tab.

17. The seat according to claim 16 wherein the supporting device comprises a pin driven into the axle through the hub.

18. The seat according to claim 9 wherein the plate comprises a plurality of ribs in contact with the cam.

* * * * *